United States Patent [19]

Respoli

[11] 4,134,525

[45] Jan. 16, 1979

[54] TRAVELING CASE FOR ARTIST BRUSHES

[76] Inventor: Patricia M. Respoli, 1315 Pentaquit Ave., Bayshore, N.Y. 11706

[21] Appl. No.: 848,866

[22] Filed: Nov. 7, 1977

[51] Int. Cl.[2] ..... A45C 11/00; B65D 9/00

[52] U.S. Cl. ..... 224/46 R; 206/1.7; 211/65; 312/244; 312/293

[58] Field of Search ..... 224/45 M, 45 R, 1 B, 224/45 G, 45 K, 45 J, 45 S, 46 R; 211/65, 74; 312/244, 293; 220/17; 206/162, 163, 203, 201, 202, 1.7, 209, 209.1

[56] References Cited

U.S. PATENT DOCUMENTS

| | | | |
|---|---|---|---|
| 1,940,091 | 12/1933 | Kapp | 224/45 G UX |
| 1,980,715 | 11/1934 | Brosler | 220/17 |
| 2,954,898 | 10/1960 | Freeberg | 224/45 K UX |
| 3,038,513 | 6/1962 | Hamlett | 312/244 UX |
| 3,349,937 | 10/1967 | Duff et al. | 312/244 UX |
| 3,741,618 | 6/1973 | Newman | 312/244 X |

*Primary Examiner*—Trygve M. Blix
*Assistant Examiner*—Jerold M. Forsberg
*Attorney, Agent, or Firm*—Edith Grill

[57] ABSTRACT

A traveling case for artist brushes which maintains said brushes, each in a separable, readily accessible, upright position, comprising an elongated rectangular container provided with a hinged door and an internal integral horizontal U-shaped rib, which functions as a stop guide for a separable two-tier brush holder slidably received within said container and maintained in a stationery position by the coaction of the upper tier of said brush holder and said rib, said two-tier brush holder being provided with a centrally located longitudinal rod which terminates in a carrying means and extending from said tiers to above the top of said container and adapted to slide into a partial slot on the top wall of said elongated container, said tiers being additionally provided with multiple openings to receive individual brushes.

8 Claims, 4 Drawing Figures

TRAVELING CASE FOR ARTIST BRUSHES

This invention relates to a novel and improved paint brush traveling case especially adapted for holding, storing, and transporting artist paint brushes, each in a separable position, and rendering them individually readily accessible and convenient for use without damaging the bristles thereof, and increasing the life span of said brushes.

DESCRIPTION OF THE PRIOR ART

The specific problems of carrying and rendering artist brushes readily accessible has been recognized in the prior art. Accordingly, sundry devices have been developed in an attempt to solve the artist's problem of maintaining his/her paint brushes in a separable and/or upright position and ready for use. One such device is a brush rack provided with a plurality of spaced notches and extending fingers to support the brushes in a horizontal position while in the carrying case as well as when attached to the side of said case when in use, as shown by U.S. Pat. Nos. 2,940,200 and 3,077,977.

The advantages to the artist of maintaining the brushes in an upright position is well recognized in the prior art. Accordingly, a cylindrical paint brush container has been developed which attaches to the leg of an easel, said container comprising an outer casing with a removable cover and an inner tube slidable within said outer casing and provided with an open grill at its upper end for holding brushes in a separable and upright position, as disclosed in U.S. Pat. No. 2,852,132. Another device for maintaining brushes in an upright and separable position is disclosed in U.S. Pat. No. 3,446,337, wherein the brushes are stored in a separate compartment in an upright supply case and held in place by a horizontal bar, which must be removed to free the brushes for use, said brushes being subsequently held by means of a coil spring attached to the box when in use.

Similarly, brush carriers generally, not specifically related to artist brushes, which hold brushes in an upright and separable position are also known as shown by U.S. Pat. No. 1,373,766 wherein the brush handles are held by clamps on a crossbar suspended over trays; and by U.S. Pat. No. 1,471,712 wherein the brush handles are suspended from notches at the side walls of the container; and by U.S. Pat. No. 3,525,429 wherein the metal portions of the brush are magnetized by means of magnets on a supporting bar.

However, none of the prior art brush carriers possess the advantages of instant novel brush carrying case which protects the artist's brushes against abuse while traveling and provides a readily removable self-supporting unit which functions to maintain the brushes upright, separated and readily accessible during use.

DESCRIPTION OF THE INVENTION

Accordingly, the present invention relates to an artist's brush carrier adapted to hold each brush in a separable and upright position and in a readily accessible manner which comprises an elongated rectangular container provided with an elongated door and closure means adapted to house a separable, self-supporting, free-standing brush holder comprising two horizontal tiers interconnected by a centrally located vertical rod provided with a carrying means at its free end, which extends above the top wall of said container, said rod being slidable within a partial slot situated on said top wall. The elongated container or housing is provided with an integral horizontal rib continuously disposed on the inside surfaces of the three vertical walls, said rib functioning as a retainer for said brush holder to maintain it in a stationery position during transit. The interrelationship of the outer housing or container and the insertable separable, self-supporting brush holder is such that the carrying means for said container is provided by the separable brush holder; and the outside container encloses and retains the brush holder in a protected and stationery position during transit.

More specifically, present invention relates to a traveling case for artist brushes adapted to hold each brush in a separable, readily accessible, upright position comprising an elongated rectangular container provided with a hinged elongated rectangular door having suitable closure means, a top wall having a partial slot, and an integral internal horizontal U-shaped guide means; adapted to house a separable, self-supporting, two-tier brush holder slidably receivable under said U-shaped guide means within said container, comprising two parallel, horizontal tiers provided with several openings, each to receive single brushes, and interconnected by a centrally located vertical rod adapted to be slidably received by said slotted top wall, said rod extending above said top wall and terminating in a carrying means.

Thus, it is apparant that instant traveling case for artist brushes provides protection to the brushes and simultaneously provides ready accessibility to said brushes without resorting to the use of attachments, adjustments and/or the like. The artist simply opens the door of the housing and slides the brush holder out from under the retaining ribs. The two-tier brush holder simply rests on a flat surface such as a table top while the artist simply removes and replaces the brushes, as needed, via the individual circular openings on the upper tier, which are positioned to correspond to the cross slits on the lower tier. When the artist wishes to move on, he/she simply inserts the brush handles into the openings on the upper tier and exerts enough pressure on the brushes so that the tips of the handles are gripped by the correspondingly positioned flaps of the cross slits on the bottom tier. This holds the brushes firmly, upright and separable, and prevents the brushes from contacting each other even when the container is turned upsidedown.

In the accompanying drawings which form a part of this application,

Figure 1:
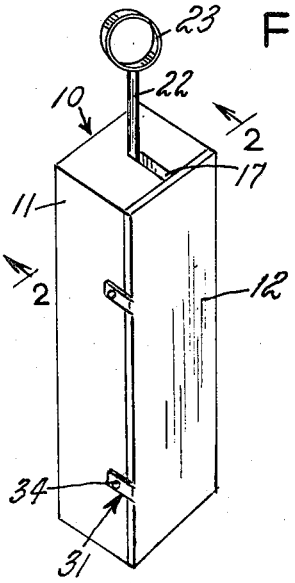
FIG. 1 is a perspective view of a closed traveling case for artist brushes in accordance with this invention.
Figure 4:
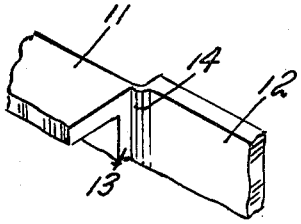
FIG. 4 is an enlarged sectional view taken on line 4—4 of FIG. 3 showing the hinge with relation to the door and side wall of the outer container.
Figure 3:
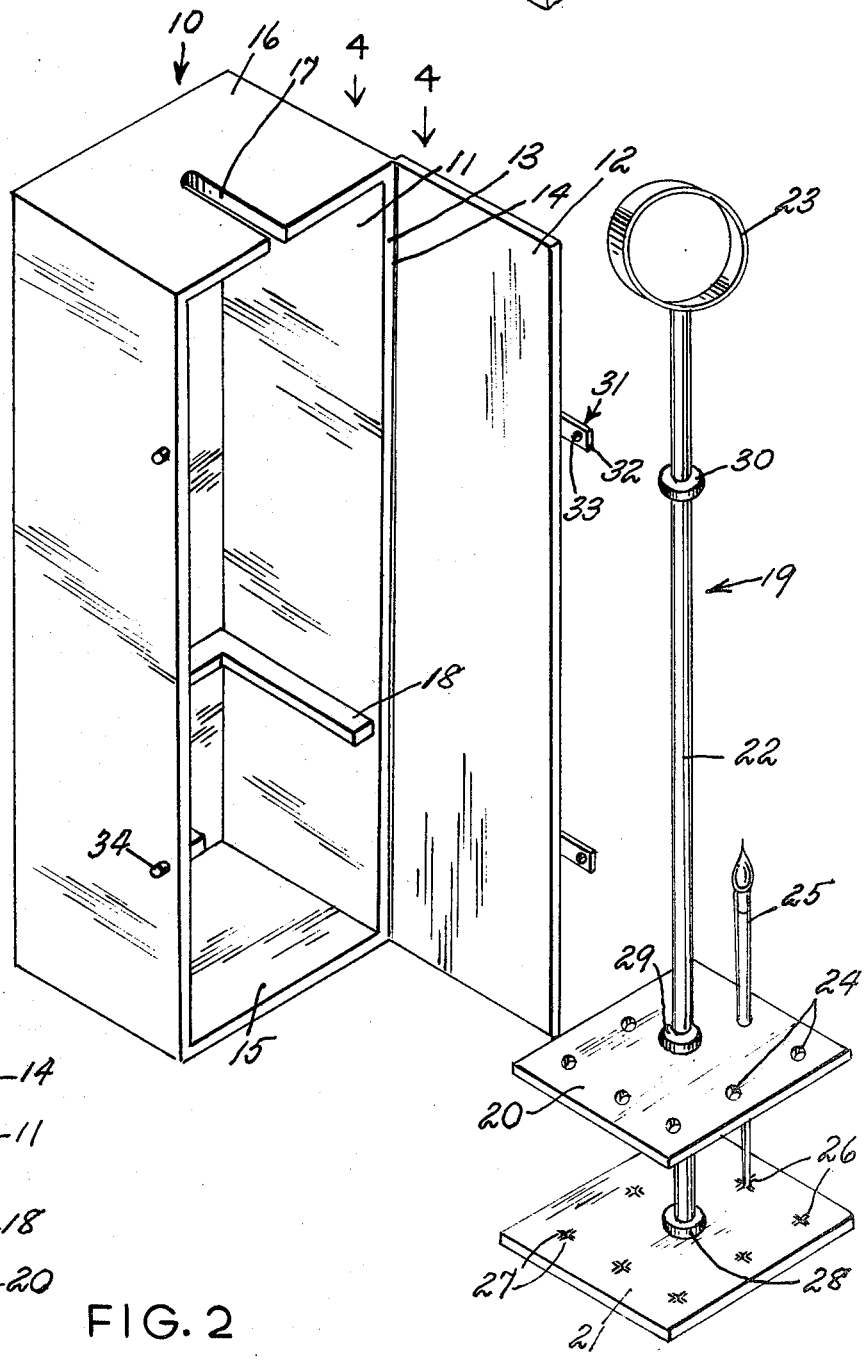
FIG. 3 is an exploded perspective view of said traveling case showing both the outer container and the separable brush holder.
Figure 2:
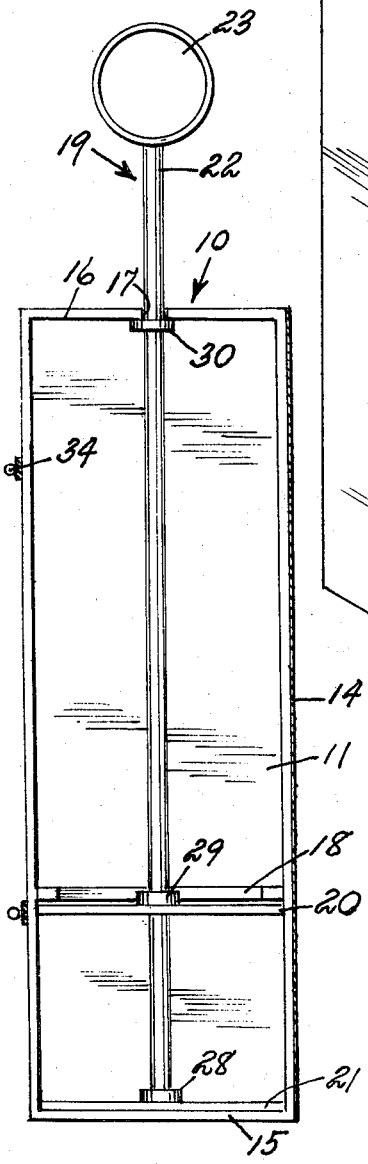
FIG. 2 is a front elevational view of said traveling case with the door removed, showing the hinge in section.

Referring now to the drawings in detail, present novel traveling case for artist brushes consists of an elongated rectangular container or housing 10 having three elongated rectangular, vertical walls 11 perpendicular to each other to form an open box; an elongated rectangular door 12 attached to the free edge 13 of vertical wall 11 by means of a hinge 14, which is a thin flexible strip running the full length of both door 12 and vertical wall 11, and preferably integral with both door 12 and vertical side wall 11; a bottom wall 15 which is perpendicular to said side walls 11; and a top wall 16 provided with a centrally located partial slot 17, which preferably extends halfway from its free edge. The vertical walls 11 are provided with an integral U-shaped horizontal rib 18 extending outwardly from the inner faces thereof, said rib 18 functioning as a stop guide for brush holder 19 to maintain said brush holder 19 in a fixed and stationery position; as well as functions as a reinforcing means for container 10. Rib 18 must be at least large enough to function as a retainer for brush holder 19, at least about ½ inch.

Elongated door 12 is provided with at least one closure means 31 preferably integral therewith, which may be in the form of a flexible flap 32, or other suitable shape having an opening 33 which is adapted to engage a coacting closure means such as a stud or peg 34 or the like, integrally attached to the outer surface of, and at the free edge of, adjacent vertical wall 11.

Container or housing 10 is preferably a unitary device, and may be molded from a suitable semi-rigid or substantially rigid, resilient plastic material such as polyethylene or similar material, with both the top wall 16 and bottom wall 15 being square, or preferably rectangular, to accomodate more brushes. All parts of container 10, namely side walls 11, door 12, bottom wall 15, and top wall 16, as well as flexible hinge 14 and closure means 31 and 34 are preferably integral with container 10. Although an integral plastic container 10 is more economical to manufacture, said container can also be made out of wood or metal with associated hinges, locks, etc., necessary to make such a container.

Brush holder 19 which is separable, self-supporting and free-standing, comprises two semi-rigid or substantially rigid parallel horizontal flat rectangular or square plates called tiers, a top tier 20, and a bottom tier 21 capable of resting on any supporting surface such as a table top; interconnected by means of a centrally located semi-rigid or substantially rigid vertical rod 22 which terminates at its free end in a carrying means 23 such as a handle, loop or other suitable carrying means, and which extends above top wall 16 of container 10, when rod 22 slides into partial slot 17 situated on top wall 16. Carrying means 23 functions as the carrying means for both brush holder 19 and for the assembled traveling case when brush holder 19 is inserted into container 10 under rib 18. The distance that rod 22 and handle 23 extend above container 10 is optional and determined only by comfort and ease of carrying, about two inches having been found to be particularly convenient.

Top tier 20 is provided with multiple small openings 24 which are preferably equally-sized and round, and small enough to maintain the brush 25 in an upright position, but large enough to accomodate the width of the brush handles. The size should be such that the brushes can readily be removed therefrom with ease. The spacing of openings 24 is such that the bristles of adjacently disposed brushes do not contact each other nor do they contact vertical walls 11 of housing 10, i.e., to afford the brushes sufficient clearance to maintain each brush separable. Openings 24 are preferably spaced about ¾ inch apart to afford maximum utilization of the available surface area of tier 20.

Bottom tier 21 may be provided with a layer of sponge or foam plastic or non-hardening clay on a solid base, said sponge layer being capable of flowing around the brush handle to grip and hold said handle firmly until pressure is exerted by the artist to release said brush. Said layer may be a gel, known as memory plastic (not shown). However, it is preferable to provide the upper surface of bottom tier 21 with cross slits 26, which are adapted to firmly secure the brush handles to bottom tier 21. When the brush handle is inserted into said cross slits 26, the flaps 27 of cross slits 26 grip the handle firmly so that some pressure must be exerted by the artist to release the brush therefrom. Cross slits 26 are situated only on the upper surface of tier 21 and are positioned to correspond with round openings 24 in tier 20 in order to maintain the brushes in an upright position. Bottom tier 21 must be of sufficient thickness and rigidity to render brush holder 19 self-supporting. When the brushes are in use, they simply rest on tier 21, and are not inserted into cross slits 26.

The distance between upper or top tier 20 and lower or bottom tier 21 is such as to accomodate the tallest brushes which are about 13 inches long, as well as the shortest brushes which are about 6–8 inches long. Accordingly, it has been found that about 4 to 5 inches and preferably 4½ inches is the optimum distance between tiers 20 and 21.

Two-tier brush holder 19 is additionally provided with coordinating and positioning means 28, 29 and 30, which may be in the form of rings, stop nuts or the like, to accomodate said brush holder 19 within said container 10. Said means 28, 29, and 30 have the dual function of maintaining the tiers 20, 21 and handle 23 in a fixed position on vertical rod 22; and coordinating with internal rib 18, bottom wall 15 and slot 17 of top wall 16 of housing 10, so that holder 19 is retained in a fixed and stationery position within container 10. The dimensions of tiers 20 and 21 of brush holder 19 must be correlated with the top and bottom walls 16 and 15 of container 10. More specifically, square tiers 20 and 21 coordinate with square top and bottom walls of container 10, and rectangular tiers coordinate with rectangular top and bottom walled containers.

Brush holder 19 is slidably received within container 10 with bottom tier 21 resting on bottom wall 15 and top tier 20 fitting under and being retained by rib guide 18 in non-frictional contact therewith. There is a small but sufficient clearance between top tier 20 and rib guide 18, so as to easily and readily slide said brush holder 19 in and out of container 10. However, when present novel traveling case is lifted and carried by means of carrying means or handle 23, top tier 20 frictionally contacts rib 18 and maintains said inserted brush holder 19 in a firm and non-movable position within container 10.

Although the traveling case may be constructed in any suitable size, it must be at least long enough to house the longest paint brushes. Accordingly, it has been found advantageous to have vertical walls at least 13 inches tall, and preferably about 15 to 17 inches tall, and most preferably about 16½ inches tall. It has also been found that the rectangular shaped tiers can accomodate the maximum number of brushes per surface area, with a four by six inch size accomodating about 12 to 16 separately spaced brushes.

Brush holder 19 may be constructed from semi-rigid or substantially rigid plastic, wood or hard cardboard, or any combination thereof. However, suitable plastic material is preferable due to its resiliency and adaptability.

Although this invention has been described with reference to specific embodiments, it will be apparant to one skilled in the art that various modifications and equivalents may be made thereto which fall within the scope herein.

I claim:

1. A traveling case for artist brushes adapted to hold each brush firmly in a separable, readily accessible, upright position comprising an elongated rectangular housing having three vertical walls perpendicular to each other and provided with a hinged elongated rectangular door having suitable closure means, a slotted top wall having a partial slot extending about halfway from its free edge, and an internal horizontal U-shaped rib guide disposed on said vertical walls; and a separable, self-supporting, two-tier brush holder insertable under said U-shaped rib within said container, said holder being retained in a stationery position by the coaction of said brush holder and said rib, said brush holder comprising two parallel horizontal tiers, an upper tier provided with several openings, each to receive single brushes, and a lower tier provided with gripping means to hold brush handles firmly, and interconnected by a centrally located vertical rod adapted to be slidably received by said slotted top wall, said rod extending above said top wall and terminating in a carrying means which is continuously accessible during and after its insertion into said housing.

2. A traveling case according to claim 1, wherein the upper surface of the bottom tier of said brush holder is provided with cross slits.

3. A traveling case according to claim 2, wherein said cross slits are positioned to correspond to the openings on the top tier.

4. A traveling case according to claim 1, wherein said closure means is integral with said door and adapted to engage a coacting closure means integral with the adjacent wall of said container.

5. A traveling case according to claim 1, wherein said container is a unitary device constructed out of semi-rigid or substantially rigid plastic, with all parts integral with each other.

6. A traveling case according to claim 1, wherein said openings on said upper tier are equally-sized and round.

7. A traveling case according to claim 1, wherein said brush holder is provided with positioning and coordinating means to accomodate said brush holder within said container.

8. A traveling case according to claim 1, wherein said tiers are flat horizontal rectangular or square plates.

* * * * *